US008668783B2

(12) United States Patent
Kimura et al.

(10) Patent No.: US 8,668,783 B2
(45) Date of Patent: Mar. 11, 2014

(54) STEEL WIRE ROD HAVING EXCELLENT DRAWABILITY AND FATIGUE PROPERTIES, AND MANUFACTURING METHOD OF THE SAME

(75) Inventors: Sei Kimura, Kakogawa (JP); Tsuyoshi Mimura, Kakogawa (JP); Tetsushi Deura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1208 days.

(21) Appl. No.: 11/459,222

(22) Filed: Jul. 21, 2006

(65) Prior Publication Data

US 2007/0051432 A1 Mar. 8, 2007

(30) Foreign Application Priority Data

Sep. 5, 2005 (JP) ..... 2005-257077
Mar. 30, 2006 (JP) ..... 2006-095305

(51) Int. Cl.
*C22C 38/00* (2006.01)

(52) U.S. Cl.
USPC ..... 148/320; 148/333; 148/540; 148/908; 120/105

(58) Field of Classification Search
USPC ..... 148/320, 333, 540, 908; 420/105
See application file for complete search history.

(56) References Cited

U.S. PATENT DOCUMENTS

| | | | |
|---|---|---|---|
| 6,328,820 | B1 | 12/2001 | Yamamoto et al. |
| 2006/0156864 | A1 | 7/2006 | Sakamoto et al. |

FOREIGN PATENT DOCUMENTS

| | | | |
|---|---|---|---|
| JP | 53-76916 | | 7/1978 |
| JP | 4-272119 | | 9/1992 |
| JP | 6-74485 | | 9/1994 |
| JP | 06306542 | * | 11/1994 |
| JP | 8003649 | * | 1/1996 |
| JP | 10-102132 | | 4/1998 |
| JP | 10-130714 | | 5/1998 |
| JP | 2000-212636 | | 8/2000 |
| JP | 2001-181793 | | 7/2001 |
| JP | 2003-49244 | | 2/2003 |
| JP | 2003073776 | * | 3/2003 |
| JP | 2005-29888 | | 2/2005 |

OTHER PUBLICATIONS

"Inclusion Control and High Purity Steel Production Technology", The 182nd and 183rd Nishiyama Memorial Technical Lecture, edited by the Iron and Steel Institute of Japan, 2004, pp. 131-137.

* cited by examiner

*Primary Examiner* — Sikyin Ip
(74) *Attorney, Agent, or Firm* — Oblon, Spivak, McClelland, Maier & Neustadt, L.L.P.

(57) ABSTRACT

A steel wire rod is obtained, in which a gas flow rate during gas stirring in molten steel treatment is controlled to be 0.0005 $Nm^3$/min to 0.004 $Nm^3$/min per molten steel of 1 ton, thereby the rod satisfies a specified composition, and oxide base inclusions in any section including an axis line of the steel wire rod satisfy the following composition X, the inclusions having width of 2 μm or more perpendicular to a rolling direction, wherein the number of the oxide base inclusions of the following composition A is 1 to 20, and the number of the oxide base inclusions of the following composition B is less than 1:

composition X: when composition of inclusions is converted to $Al_2O_3$+MgO+CaO+$SiO_2$+MnO=100%, $Al_2O_3$+CaO+$SiO_2$≥70% is given.

composition A: when composition of inclusions is converted to $Al_2O_3$+CaO+$SiO_2$=100%, 20%≤CaO≤50% and $Al_2O_3$≤30% are given; and composition B: when composition of inclusions is converted to $Al_2O_3$+CaO+$SiO_2$=100%, CaO>50% is given.

In the steel wire rod, drawability and fatigue properties are improved to the utmost.

9 Claims, 2 Drawing Sheets

STEEL WIRE ROD HAVING EXCELLENT DRAWABILITY AND FATIGUE PROPERTIES, AND MANUFACTURING METHOD OF THE SAME

BACKGROUND OF THE INVENTION

1. Field of the Invention

The present invention relates to a steel wire rod having excellent drawability and fatigue properties and a manufacturing method of the wire rod, and particularly relates to a steel wire rod in which non-metallic inclusions that are hard and have extremely small ductility are decreased and thus drawability and fatigue properties are improved, and a useful method for manufacturing the steel wire rod.

2. Description of Related Art

When the non-metallic inclusions that are hard and have extremely small ductility (particularly oxide base inclusions, hereinafter, sometimes called merely "inclusions") exist in a steel wire rod, the non-metallic inclusions may cause breakage in a process of drawing the rod to an ultra-fine steel wire such as a tire cord. Moreover, when the steel wire rod is used for spring manufacturing, fatigue fracture may start from the non-metallic inclusions in a condition that repeated stress is loaded to obtained products (springs). Therefore, it is essential that the non-metallic inclusions are reduced to the utmost or softened to increase ductility in order to eliminate adverse influence of the inclusions in a manufacturing process of the steel wire rods.

In the light of improving softness and ductility of the non-metallic inclusions in the steel wire rod, various techniques have been proposed. For example, U.S. Pat. No. 6,328,820, JP-A No. 2003-49244 and JP-B No. 6-74485 show methods of improving softness and ductility of the inclusions by controlling a composition of the non-metallic inclusions in steel to be within a certain range. Specifically, U.S. Pat. No. 6,328,820 shows that the number of oxide base inclusions 5 μm or less in thickness is controlled to be within a certain range with respect to all oxide base inclusions in an L-section of rolled steel, thereby certain fatigue properties can be ensured. However, the number of oxide base inclusions 5 μm or less in thickness is specified only in a ratio of at least 80% in the L-section of the rolled steel, and further improvement is considered to be required for securely improving the fatigue properties.

JP-A No. 2003-49244 specifies that among non-metallic inclusions detected in the L-section of the rolled steel, at least 80% of non-metallic inclusions, in which a ratio L/D of the major axis (L) to the minor axis (D) is more than 5, and D is 10 μm or more, include 10 to 40% of CaO, 30 to 50% of $SiO_2$, 1 to 5% of MnO, 1 to 10% of $Al_2O_3$, and 5 to 20% of $Na_2O$. However, the technique is directed to only coarse inclusions as control objects, and the above composition is shown only in an average composition of existing non-metallic inclusions. Consequently, further investigation is necessary for securely improving drawability and the like.

JP-B No. 6-74485 discloses a high cleanliness steel having excellent cold workability and fatigue properties, including non-metallic inclusions having a ratio $l/d \leq 5$ of length (l) to width (d) in the L-section of the rolled steel, of which the average composition is 30 to 50% of $SiO_2$, 1 to 10% of $Al_2O_3$, 50% or less of CaO, and 50% or less of MgO. However, again in the technique, the composition of the non-metallic inclusions is controlled only in the average composition, and therefore secure improvement in fatigue properties is considered to be difficult.

On the other hand, JP-A No. S53-76916, JP-A No. H4-272119, JP-A No. 2000-212636, JP-A No. H10-102132, and the 182$^{nd}$, 183rd Nishiyama Memorial Technical Seminar "Inclusion Control and Material Manufacturing Technology of High Cleanliness Steel", edited by The Iron and Steel Institute of Japan 2004, p 138, show methods that a slag composition is controlled in a certain range in molten steel refining, and molten steel and slag are stirred to be contacted and mixed in order to reform inclusions to be soft and ductile. While a method for contacting the molten steel and the slag is considered to be also important for inclusion control, JP-A No. S53-76916 and JP-A No. H4-272119 do not specifically show such a method. The "Inclusion Control and Material Manufacturing Technology of High Cleanliness Steel" show a phenomenon that a slag having 0.8 to 1.2 of $CaO/SiO_2$ in a $CaO/SiO_2$ system is used for molten steel treatment, thereby non-ductile inclusions are decreased. However, when a molten steel treatment method, that is, a contact mixing method of slag and molten steel is not appropriate, the inclusions are hardly decreased sufficiently. While JP-A No. 2000-212636 and JP-A No. H10-102132 describe control of a rate of blowing gas during refining, in either case the gas rate is high, and therefore inclusions due to the slag are considered to be easily produced.

SUMMARY OF THE INVENTION

It is desirable to provide a steel wire rod in which hard and non-ductile inclusions are decreased and thus drawability and fatigue properties are improved, and a useful method for manufacturing the steel wire rod.

The steel wire rod having excellent drawability and fatigue properties according to an embodiment of the invention includes, 0.4 to 1.3% of C (mass percent, hereinafter same for a steel composition), 0.1 to 2.5% of Si, 0.2 to 1.0% of Mn, and 0.003% or less of Al (exceeding 0%);

and contains oxide base inclusions in a section including an axis line of the steel wire rod, the inclusions having width of 2 μm or more perpendicular to a direction of the axis line, and satisfying the following composition X, composition X: when $Al_2O_3+MgO+CaO+SiO_2+MnO=100\%$ (mass percent, hereinafter same for inclusions) is assumed, $Al_2O_3+CaO+SiO_2 \geq 70\%$ is given;

wherein the number of the oxide base inclusions satisfying the following composition A is 1 to 20 per a section of 100 $mm^2$ including the axis line of the steel wire rod, and the number of the oxide base inclusions satisfying the following composition B is less than 1 per a section of 100 $mm^2$ including the axis line of the steel wire rod:

composition A: when $Al_2O_3+CaO+SiO_2=100\%$ is assumed, $20\% \leq CaO \leq 50\%$ and $Al_2O_3 \leq 30\%$ are given; and composition B: when $Al_2O_3+CaO+SiO_2=100\%$ is assumed, $CaO > 50\%$ is given.

The steel wire rod may further contain the following as other elements:

(a) 0.05 to 1% of Ni, (b) 0.05 to 1% of Cu and/or 0.05 to 1.5% of Cr, and (c) at least one selected from a group including 0.02 to 20 ppm of Li, 0.02 to 20 ppm of Na, 3 to 100 ppm of Ce, and 3 to 100 ppm of La.

The embodiment of the invention also specifies a manufacturing method of the steel wire rod, in which a gas flow rate during gas stirring in molten steel treatment is controlled to be 0.0005 $Nm^3$/min to 0.004 $Nm^3$/min (N means normal; volume at 298 K and $10^5$ Pa, hereinafter same) per molten steel of 1 ton.

The "steel wire rod" is a rod after hot rolling and before drawing, and distinguished from the "steel wire" obtained by drawing.

According to the embodiment of the invention, the hard and non-ductile inclusions in the steel wire rod are decreased, and a steel wire rod is obtained, the rod exhibiting excellent drawability during drawing and having excellent fatigue properties, and consequently a high-strength ultra-fine wire such as tire cord, or a steel wire rod optimum for manufacturing springs required to have high fatigue properties can be efficiently provided.

DESCRIPTION OF THE PREFERRED EMBODIMENT

Figure 1:
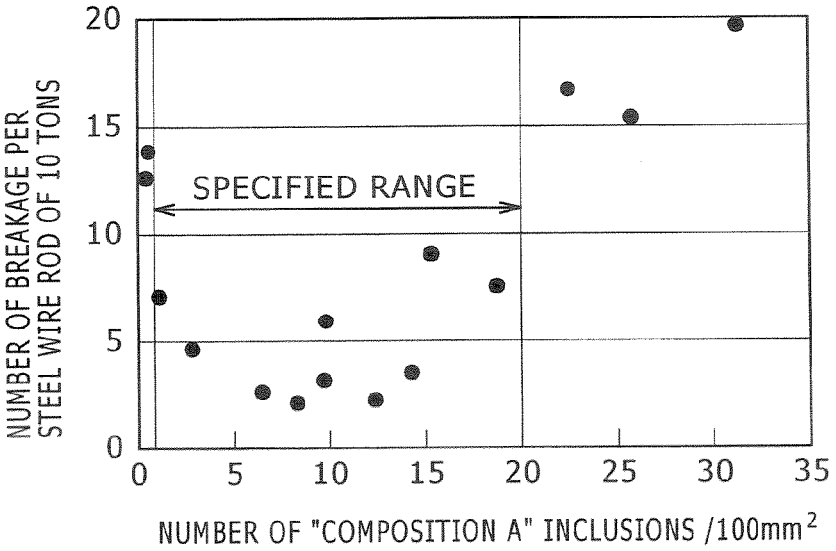
FIG. 1 is a graph showing a relation between the number of composition-A inclusions and the number of breakages per steel wire rod of 10 tons.

The inventors have conducted earnest study to obtain a steel wire rod having more excellent drawability and fatigue properties and study to establish a manufacturing method for obtaining the steel wire rod.

To obtain the steel wire rod having more excellent drawability and fatigue properties, it is effective to control morphologies of inclusions in the steel wire rod, and the invention found that when size and a composition of each inclusion are understood, so that the number of inclusions having a certain size and composition is controlled, rather than the average composition of existing inclusions in the related art, the drawability and the fatigue properties can be improved more securely. Hereinafter, detailed description is made on an inclusion morphology specified by the embodiment of the invention and a reason for such specification.

First, the embodiment of the invention is directed to oxide base inclusions in a section including an axis line of the steel wire rod as control objects, the inclusions having width perpendicular to an axis line direction, that is, width perpendicular to a rolling direction of 2 μm or more. This is because inclusions having the width perpendicular to the rolling direction of less than 2 μm does not have influence on drawability or a fatigue life of the steel wire rod. Here, the axis line is a central axis extending in a longitudinal direction of a wire rod. The section including the axis line of the steel wire rod is a section formed when the wire rod is cut in a plane extending in a longitudinal direction of the wire rod and having a center axis of the wire rod thereon.

The steel wire rod of the embodiment of the invention is obtained in a way that molten steel having $SiO_2$ due to a deoxidizing element, or $Al_2O_3$ due to Al contained in loaded metal material and the like is mixed with CaO—$SiO_2$—$Al_2O_3$ system slag for refining in slag refining. Therefore, the oxide base inclusions in the steel wire rod mainly contain three components of CaO, $SiO_2$ and $Al_2O_3$. MgO in the oxide base inclusions is contained due to a refractory for molten steel, and MnO is contained due to Mn added as a molten steel component, and the MgO and MnO are inevitably mixed in the inclusions. The amounts of other components ($TiO_2$, $ZrO_2$ and the like) that may form the oxide base inclusions are extremely slight.

Thus, the oxide base inclusions in the section including the axis line of the steel wire rod manufactured according to an aspect described above, the inclusions having width of 2 μm or more perpendicular to a rolling direction, mainly contain the three components of CaO, $SiO_2$ and $Al_2O_3$ as above. In the embodiment of the invention, it is supposed that the oxide base inclusions satisfy the following composition X to make it clear that the oxide base inclusions are control objects:

composition X: when composition of inclusions is converted to $Al_2O_3$+MgO+CaO+$SiO_2$+MnO=100% (mass percent), $Al_2O_3$+CaO+$SiO_2$≥70% is given.

The invention further investigated on a relation between a detailed composition (that is, a component ratio of $Al_2O_3$, CaO, and $SiO_2$) of the oxide base inclusions of the composition X, and drawability and fatigue properties.

As a result, the following were found:

the number of the oxide base inclusions satisfying the following composition A (oxide base inclusions satisfying the composition A in this way among the oxide base inclusions that satisfy the composition X and have width of 2 μm or more perpendicular to a rolling direction may be called merely "composition-A inclusions" hereinafter) is 1 to 20 per a section of 100 $mm^2$ including the axis line of the steel wire rod, and the number of the oxide base inclusions satisfying the following composition B (oxide base inclusions satisfying the composition B in this way among the oxide base inclusions that satisfy the composition X and have width of 2 μm or more perpendicular to a rolling direction may be called merely "composition-B-inclusions" hereinafter) is less than 1 per a section of 100 $mm^2$ including the axis line of the steel wire rod;

composition A: when composition of inclusions is converted to $Al_2O_3$+CaO+$SiO_2$=100%, 20%≤CaO≤50% and $Al_2O_3$≤30% are given; and composition B: when composition of inclusions is converted to $Al_2O_3$+CaO+$SiO_2$=100%, CaO>50% is given.

FIG. 1 shows a relation between the number of the composition-A inclusions (per section of 100 $mm^2$ including the axis line of the steel wire rod) and the number of breakages (the number of breakages per steel wire rod of 10 tons) in a drawing process of an example 1 described later. From FIG. 1, it is known that the number of the composition-A inclusions is necessarily controlled to be 20 or less (preferably 15 or less) to control the number of breakages per steel wire rod of 10 tons to 10 times or less. When the number of the composition-A inclusions exceeds 20, the inclusions adversely affect on the drawability or fatigue life considerably significantly even if size of the inclusions is small. Furthermore, from FIG. 1, when the number of the composition-A inclusions is significantly small, the number of breakages per steel wire rod of 10 tons is abruptly increased. This is considered to be because the considerably small number of composition-A inclusions indicates a state of large number of hard inclusions. In the embodiment of the invention, the number of the composition-A inclusions was decreased to be at least 1 (preferably at least 2) in order to control the number of breakages per steel wire rod of 10 tons to be 10 or less.

Figure 2:
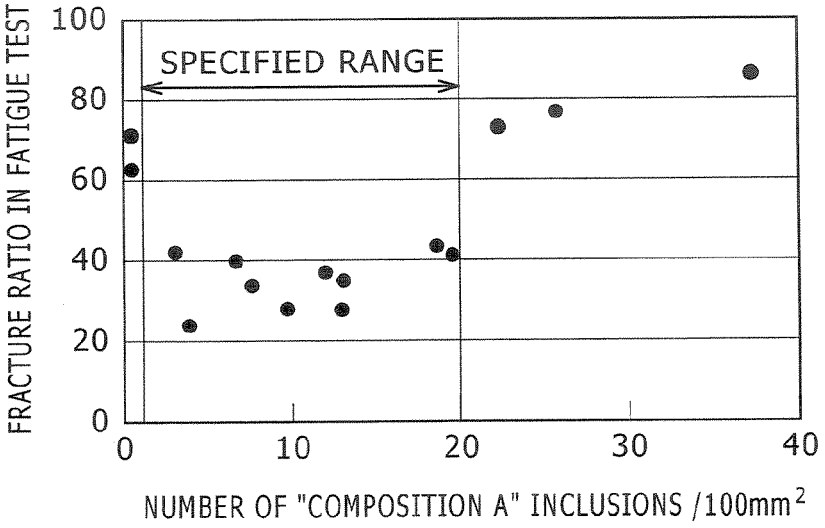
FIG. 2 is a graph showing a relation between the number of composition-A inclusions and a fracture ratio in a fatigue test.

FIG. 2 shows a relation between the number of the composition-A inclusions (per section of 100 $mm^2$ including the axis line of the steel wire rod) and a fracture ratio in a fatigue test of example 2 described later. From FIG. 2, it is known that the number of the composition-A inclusions is necessarily controlled to be 20 or less (preferably 15 or less) similarly as above to control the fracture ratio in the fatigue test to be 60% or less. On the other hand, when the number of the composition-A inclusions is significantly small, the fracture ratio in the fatigue test is abruptly increased. From this, it is known that the number of the composition-A inclusions is necessary to be at least 1 (preferably at least 2) in the light of securing the fatigue properties by controlling the fracture ratio in the fatigue test to 60% or less.

Figure 3:
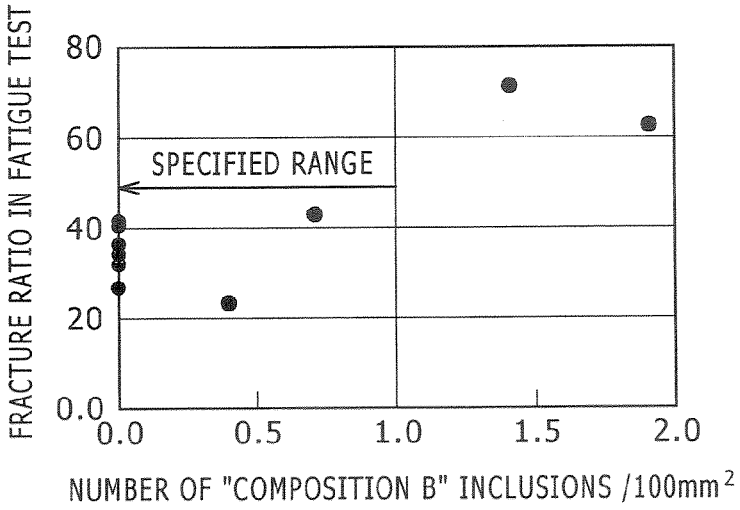
FIG. 3 is a graph showing a relation between the number of composition-B inclusions and a fracture ratio in a fatigue test.

The invention controls the hard composition-B-inclusions. FIG. 3 shows a relation between the number of the composition-B-inclusions and the fracture ratio in the fatigue test, and indicates that when the number of the composition-B-inclusions is increased to be at least 1 per section of 100 $mm^2$ including the axis line of the steel wire rod, the fracture ratio in the fatigue test exceeds 60%.

The composition-B-inclusions is generated mainly due to CaO introduced in a process (for example, converter process) before the molten steel treatment, and when the molten steel treatment is not appropriately carried out, the composition-B inclusions containing the CaO as a main component is left in the steel wire rod. Since the composition-B inclusions reduce the fatigue life even if size of the inclusions is 5 μm or less, they need to be reduced to the utmost. Therefore, in the embodiment of the invention, the number of the composition-B inclusions is decreased to less than 1 (preferably 0.7 or less).

In the steel wire rod of the embodiment of the invention, the amount of Al in the composition is particularly controlled as shown below, and C, Si and Mn are contained in the same level as in the typical steel for drawing such as steel cord or spring steel as shown below. The steel wire rod may contain Ni, Cu, Cr, Li, Na, Ce or La in an intentional manner to add an effect such as further improvement in strength.

<C: 0.4 to 1.3%>

C is a useful element for improving strength, therefore contained at least 0.4%. Preferably, it is contained at least 0.5%. However, excessive amount of C causes embrittlement of steel, resulting in deterioration in drawability. Therefore, the amount is controlled to be 1.3% or less (preferably 1.2% or less).

<Si: 0.1 to 2.5%>

Si is an element having a deoxidizing function, and needs to be contained at least 0.1% to exhibit the function. Preferably, it is contained at least 0.2%. However, excessive amount of Si causes large amount of $SiO_2$ as a deoxidization product, resulting in deterioration in drawability. Therefore, the amount is controlled to be 2.5% or less (preferably 2.3% or less).

<Mn: 0.2 to 1.0%>

Mn is an element having the deoxidizing function like Si, and has a function of controlling inclusions. To effectively exhibit the functions, Mn is contained at least 0.2% (preferably at least 0.3%). On the other hand, excessive amount of Mn causes embrittlement of steel, resulting in deterioration in drawability. Therefore, the amount is controlled to be 1.0% or less (preferably 0.9% or less).

<Al: 0.003% or less (exceeding 0%)>

Al is a useful element for controlling inclusions, and needs to be contained about 0.001%. However, increased amount of Al leads to high $Al_2O_3$ concentration in inclusions, resulting in production of coarse $Al_2O_3$ causing breakage. Therefore, the amount is controlled to be 0.003% or less (preferably 0.002% or less).

Composition elements specified by the embodiment of the invention are as above, and the remainder includes iron and inevitable impurities. As the inevitable impurities, some elements may be introduced depending on situations of raw materials, materials, manufacturing equipment and the like. Furthermore, it is effective that the following elements are intentionally contained to further improve characteristics of the wire rod.

<Ni: 0.05 to 1%>

Ni is an element that exhibits an effect of improving toughness of a drawn wire rod. To exhibit the effect, Ni is preferably contained at least 0.05%, and more preferably contained at least 0.06%. However, since excessive Ni merely results in saturation of the effect, Ni is preferably contained 1% or less (more preferably 0.9% or less).

<Cu: 0.05 to 1% and/or Cr: 0.05 to 1.5%>

Cu and Cr are elements of contributing to increase in strength of a steel wire, and particularly Cu is a useful element for improving strength of the steel wire by a precipitation hardening effect. To exhibit the effect of Cu, Cu is preferably contained at least 0.05%, and more preferably at least 0.06%. However, when Cu is excessively contained, it may segregate into grain boundaries, consequently cracks or flaws tend to appear during a hot rolling process of steel. Therefore, Cu is preferably contained 1% or less (more preferably 0.9% or less).

Cr has a function of improving a work hardening ratio during drawing, by which high strength can be easily ensured even at comparatively low processing rate. In addition, Cr has a function of improving corrosion resistance of steel, and for example, when it is used for a reinforcement material (ultra-fine steel) of rubber such as tire, it effectively functions for suppressing corrosion of the ultra-fine steel. To exhibit the effect, Cr is preferably contained at least 0.05%, and more preferably at least 0.06%. However, excessive amount of Cr increases hardenability in pearlite transformation, resulting in difficulty in patenting treatment. Furthermore, secondary scales become significantly tight, resulting in deterioration in performance of mechanical descaling and acid pickling. Accordingly, the amount of Cr is preferably 1.5% or less, and more preferably 1.4% or less.

<At least one selected from a group including 0.02 to 20 ppm of Li, 0.02 to 20 ppm of Na, 3 to 100 ppm of Ce, and 3 to 100 ppm of La>

The elements have a function of softening non-metallic inclusions in steel. To exhibit such an effect, the steel wire rod preferably contains 0.02 ppm or more (more preferably 0.03 ppm or more) for Li, 0.02 ppm or more (more preferably 0.03 ppm or more) for Na, 3 ppm or more (more preferably 5 ppm or more) for Ce, and 3 ppm or more (more preferably 5 ppm or more) for La. However, since excessive content of the elements cause merely saturation of the effect, Li and Na are preferably controlled to be 20 ppm or less (more preferably 10 ppm or less) respectively. Ce and La are preferably controlled to be 100 ppm or less (more preferably 80 ppm or less) respectively.

Furthermore, the inventors found that when slag and molten metal are stirred in ladle refining, a gas flow rate can be controlled in order to obtain a steel wire rod having the number of the composition-A-inclusions of 1 to 20 and the number of the composition-B inclusions of less than 1.

It has been known that inclusions in blooms or billets are softened and easily drawn in hot rolling or drawing by performing molten steel treatment using slag having an appropriate composition. However, as described before, if a method of molten steel treatment, that is, a contact mixing method between the slag and the molten steel is not appropriate, sufficient decrease in the number of the non-ductile inclusions are hardly achieved.

The inventors investigated a relation between the stirring gas rate when the slag and the molten metal are stirred in the ladle refining (hereinafter, sometimes called simply "gas flow rate") among various manufacturing conditions in ingoting which may affect on the morphology of inclusions, and morphology of inclusions. Specifically, wire rods 5.5 mm in diameter were produced with the gas flow rate being changed, and the number of the composition-A-inclusions or the composition-B inclusions (per section of 100 $mm^2$ including an axis line) was measured (other manufacturing conditions, and a method of measuring the number of the composition-A-inclusions and the composition-B inclusions are the same in example 1 described later), and then the relation between the gas flow rate and the number of the composition-A-inclusions or the composition-B inclusions was arranged. Results are shown in FIG. 4.

Figure 4:
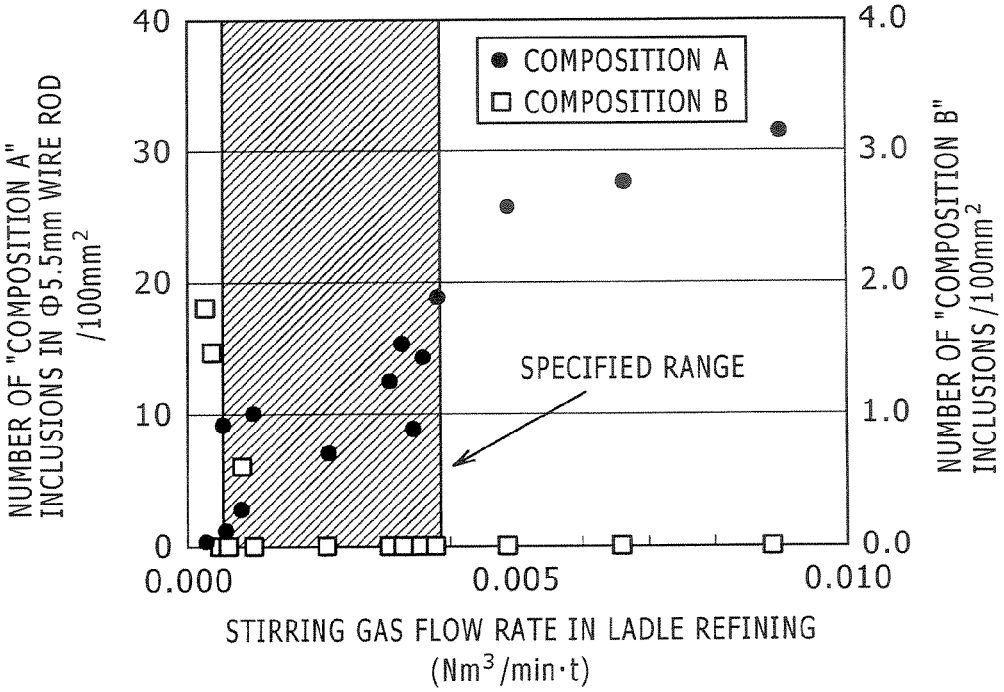
FIG. 4 is a graph showing influence of a stirring gas rate in ladle refining on the number of composition-A inclusions and the number of composition-B inclusions.

From FIG. 4, it is known that when the gas flow rate is less than 0.0005 $Nm^3$/min per molten steel of 1 ton, the number of the composition-A-inclusions is extremely small, and the composition-B inclusions are significantly increased. This is considered to be because a level of contact between the slag and the molten steel is low in the gas rate, therefore large amount of inclusions containing large amount of CaO introduced in the process before molten steel treatment are left in addition to the hard inclusions containing large amount of $SiO_2$ or $Al_2O_3$ produced in a deoxidization process.

In the embodiment of the invention, the gas flow rate is controlled to be at least 0.0005 $Nm^3$/min per molten steel of 1 ton for mixing the slag and the molten steel, thereby the inclusions containing large amount of CaO introduced in the process (for example, converter process) before molten steel treatment or the hard inclusions containing the large amount of $SiO_2$ or $Al_2O_3$ produced in the deoxidization process of the molten steel can be reformed into the soft composition-A-inclusions.

To secure the composition-A-inclusions so that the number of the composition-B inclusions is securely decreased, the gas flow rate is preferably controlled to be at least 0.0006 $Nm^3$/min per molten steel of 1 ton, and more preferably at least 0.0007 $Nm^3$/min.

Increase in the gas flow rate is preferable because the composition-A-inclusions are proportionally increased, and the composition-B inclusions are relatively decreased, however, while the composition-A-inclusions are soft, excessive amount of the inclusions reduces drawability or fatigue strength. Moreover, when the gas flow rate is increased, a ladle refractory is significantly worn out during gas stirring, which is not preferable for operation, in addition, the refractory may be mixed into the molten steel, which adversely affects on products. Therefore, the gas flow rate is controlled to be 0.004 $Nm^3$/min or less per molten steel of 1 ton. Preferably it is 0.0035 $Nm^3$/min or less, and more preferably it is 0.003 $Nm^3$/min or less.

In this way, in the embodiment of the invention, the gas flow rate during gas stirring in molten steel treatment is controlled to be in a region of a gas flow rate of 0.0005 $Nm^3$/min to 0.004 $Nm^3$/min per molten steel of 1 ton, the region being at a level lower than a typically used level, thereby a state of the oxide base inclusions in steel, which has not been found, can be realized.

While a type of gas used for the stirring is not particularly limited, argon is appropriate, which does not react with molten steel and is available at comparatively low price. Moreover, a gas blowing method is not limited, and a blowing method from an upper side of molten steel and a blowing method from a bottom or a side of a ladle can be employed.

The effect of adjustment of the gas flow rate during gas stirring in molten steel treatment is based on adjustment of a contact level between slag and molten steel. In addition to the gas flow rate, gas blowing power, a gas blowing position, and gas stirring time may affect on the contact level between slag and molten steel. However, the gas blowing power and the gas blowing position are hardly changed in view of influence on the ladle refractory or uniformity of temperature or a composition of molten steel. If enough time to be required is ensured for the gas stirring time, the effect of stirring is saturated even if further time is given. Therefore, the gas flow rate is approximately dominant for influence on the contact level between slag and molten steel.

As the slag, as disclosed in the aforementioned JP-A No. S53-76916, JP-A No. H4-272119, and JP-A No. 2000-212636, CaO—$SiO_2$—$Al_2O_3$ base slag can be formed by adding flux, and for example, flux in which CaO and $SiO_2$ are mixed in a ratio of 35 to 55 mass percent of CaO and 45 to 65 mass percent of $SiO_2$ is added, or slag is controlled to be in a composition as a composition in the example described later. Alternatively, slag that satisfies 0.6 to 1.2 of CaO/$SiO_2$, 2 to 10 mass percent of $Al_2O_3$, 30 mass percent or less of $CaF_2$ (including 0%), and NaF of 10 mass percent or less (including 0%) as described in JP-A No. 2000-212636 can be used.

The steel wire rod of the embodiment of the invention has a section diameter of 3 to 10 mm, and is useful for manufacturing a ultra-fine high-strength steel wire such as tire cord or piano wire required to have high drawability in a drawing process. Moreover, it is useful for manufacturing springs, wires or the like that are required to have high fatigue properties.

Hereinafter, while the embodiment of the invention is described more specifically with giving examples, the embodiment of the invention is not essentially limited by the following examples, and can be carried out with appropriate modifications within a scope adaptable for purport described before and after, and any of them are included within a technical scope of the embodiment of the invention.

EXAMPLES

Example 1

Evaluation of Drawability

Various kinds of molten iron of 240 tons in which P had been decreased to 0.007 to 0.020%, and S had been decreased to 0.002 to 0.01% in a pretreatment process of molten iron were loaded into a converter together with cold iron of 0 to 5 tons and/or scrap steel of 0 to 4 tons. At that time, the molten iron, cold iron and scrap iron were mixed such that average P concentration of all the iron sources was 0.020% or less. In the converter, the iron sources were subjected to decarburization blowing to have a predetermined concentration, then tapped out into a ladle, and then subjected to composition adjustment (regarding the composition, see the following Table 1) and slag refining in ladle furnace. Slag in the ladle refining was CaO—$SiO_2$—$Al_2O_3$ base slag having CaO/$SiO_2$ of 0.7 to 1.7 and $Al_2O_3$ of 4 to 25%. Ar was used for the stirring gas during the ladle refining, and a flow rate of the gas was changed within a range of 0.0003 to 0.012 $Nm^3$/min per molten steel of 1 ton. Gas stirring time was 15 min or more in each case.

Continuous casting was performed subsequently to the ladle refining, as a result a bloom having a section of 600 mm×380 mm was obtained. An Ar gas flow rate for purging into a tundish in the continuous casting was controlled to be 0.04 to 0.10 $Nm^3$/min per molten steel of 1 ton in the tundish for preventing increase in total amount of inclusions or change in composition due to reoxidation of the molten steel. Then, the bloom was heated to 1260° C., and subjected to blooming until a section of the bloom was reduced to 155 mm square, and then further subjected to hot rolling and consequently wire rods 5.5 mm in diameter were obtained.

A composition, size, and the number of inclusions in the obtained each of steel wire rods were investigated as follows. That is, a section including an axis of the obtained wire rod was cut out to be able to be observed, then the whole area of the section (observation area: 108 to 280 $mm^2$) was observed by EPMA (Electron Probe MicroAnalyzer, manufactured by JEOL (JXA-8000 series)), and it was confirmed by a method described in detail below that oxide base inclusions having width of 2 μm or more perpendicular to a rolling direction in the section satisfied the following composition X respectively, and then among the oxide base inclusions having the width of 2 μm or more perpendicular to the rolling direction, the number of inclusions satisfying the composition A, and the number of inclusions satisfying the composition B were measured by a method described in detail below respectively, and then converted into numbers per a section of 100 $mm^2$ including an axis line of the steel wire rod. Since the number of the oxide base inclusions having the width of more than 5 μm was extremely small, the oxide base inclusions having the width of 2 μm to 5 μm were taken as observation objects. The results are shown together in Table 1.

Composition X: when composition of inclusions is converted to $Al_2O_3$+MgO+CaO+$SiO_2$+MnO=100% (mass percent), $Al_2O_3$+CaO+$SiO_2$≥70% is given.

Composition A: when composition of inclusions is converted to $Al_2O_3$+CaO+$SiO_2$=100%, 20%≤CaO≤50% and $Al_2O_3$≤30% are given.

Composition B: when composition of inclusions is converted to $Al_2O_3$+CaO+$SiO_2$=100%, CaO>50% is given.

For determination of the composition, size, and the number of the inclusions, a combination of the EPMA with an automatic image analyzer manufactured by Noran & Reeds Inc, was used. Observation magnification was set to be 500 magnifications (a level that an object 2 to 5 μm in diameter was observed as an object 1 to 2.5 mm in diameter), and 1200 to 3000 visual fields (an observation area was 108 to 280 $mm^2$) were observed assuming that an area of one visual field was 300 μm×300 μm. Quantitative analysis was performed by energy distribution spectroscopy of characteristic X-rays at a condition of double acceleration voltage of 20 kV and specimen current of 0.01 μA. As elements of determination objects, Al, Mn, Si, Mg, Ca, Ti, Zr, K, Na, S and O were taken. In a determination method, X-ray intensity of a substance having known concentration of the above elements was measured, thereby a relation between the X-ray intensity and the concentration of the elements was known and a working curve of the relation was previously made, then concentration of each element was obtained from X-ray intensity of inclusions as observation objects using the working curve. Assuming that respective elements of Al, Mn, Si, Mg, Ca, Ti, Zr, K, Na, and S existed in forms of $Al_2O_3$, MnO, $SiO_2$, MgO, CaO, $TiO_2$, $ZrO_2$, $K_2O$, $Na_2O$ and S, concentration of $Al_2O_3$, MnO, $SiO_2$, MgO, CaO, $TiO_2$, $ZrO_2$, $K_2O$, $Na_2O$ and S in the inclusions were calculated based on the concentration of respective elements obtained by the determination. Then, whether the inclusions correspond to the composition A or the composition B was determined, and then the number of the inclusions corresponding to each composition was obtained. The result is shown together in Table 1 showing the chemical compositions of the steel wire rods.

As examples of detailed measurement results of morphologies of the inclusions, a measurement result of No. 3 shown in Table 1 is shown in Table 2, and a measurement result of No. 7 is shown in Table 3. Similar measurement was performed for other examples.

Next, drawability in the case of applying the steel wire rods to a tire cord was evaluated according to the following procedure.

[Evaluation Method]

The number of breakages of the wire rods in drawing from 5.5 mm in diameter to 0.2 mm in diameter was evaluated.

[Drawing Method]

Scales were removed from the steel wire rods 5.5 mm in diameter using hydrochloric acid, then the rods were subjected to dry drawing by a continuous drawing machine (manufactured by Showa Kikai corp., type CD-610-7+BD610) to a diameter of 1.2 mm. Diameters of drawing dices used in the drawing process were 4.8, 4.2, 3.7, 3.26, 2.85, 2.5, 2.2, 1.93, 1.69, 1.48, and 1.3 (all are in a unit of mm). Wire drawing speed at the diameter of 1.2 mm was 400 m/min. In drawing, zinc phosphate coating was previously applied on surfaces of the wire rods, and a lubricant mainly including sodium stearate was used.

Wire rods drawn to the diameter of 1.2 mm were heated to 1230 K, then subjected to patenting treatment in a lead bath at 830 K to have a fine pearlite structure, and then subjected to brass plating (thickness: about 1.5 μm) of Cu:Zn=7:3 (mass ratio). Finally, the wire rods were subjected to a drawing process to a diameter of 0.2 mm using a wet drawing machine (manufactured by KOCH inc., type KPZIII/25-SPZ250). For a dipping bath during drawing, a solution containing water of 75 mass percent, and a natural fatty acid, an amine salt, and a surfactant, which were mixed to the water, was used. Diameters of drawing dices used in the drawing process were 1.176, 0.959, 0.880, 0.806, 0.741, 0.680, 0.625, 0.574, 0.527, 0.484, 0.444, 0.408, 0.374, 0.343, 0.313, 0.287, 0.260, 0.237, and 0.216 (all are in a unit of mm). Wire drawing speed at the diameter of 0.2 mm was 500 m/min.

The results are shown together in Table 1 described below.

TABLE 1

| | Chemical composition[X] (Li, Na, Ce, and La are in ppm, others are in mass percent) | | | | | | | | | | | Gas flow rate | Number of inclusions/100 $mm^2$ | | Number of disconnection times |
|---|---|---|---|---|---|---|---|---|---|---|---|---|---|---|---|
| No. | C | Si | Mn | Al | Ni | Cu | Cr | Li | Na | Ce | La | ($Nm^3$/min * t) | composition A | composition B | per 10 tons |
| 1 | 0.71 | 0.22 | 0.45 | 0.000 | 0.00 | 0.00 | 0.00 | 0.00 | 0.00 | 0 | 0 | 0.0006 | 8.9 | 0.0 | 6.0 |
| 2 | 0.73 | 0.21 | 0.48 | 0.002 | 0.00 | 0.00 | 0.00 | 0.00 | 0.00 | 27 | 0 | 0.0007 | 1.2 | 0.0 | 7.1 |
| 3 | 0.78 | 0.35 | 0.52 | 0.001 | 0.00 | 0.00 | 0.00 | 0.00 | 0.00 | 0 | 0 | 0.0009 | 2.9 | 0.6 | 4.5 |

TABLE 1-continued

| No. | Chemical composition※ (Li, Na, Ce, and La are in ppm, others are in mass percent) | | | | | | | | | | | Gas flow rate | Number of inclusions/100 mm² | | Number of disconnection times |
|---|---|---|---|---|---|---|---|---|---|---|---|---|---|---|---|
| | C | Si | Mn | Al | Ni | Cu | Cr | Li | Na | Ce | La | ($Nm^3$/min * t) | composition A | composition B | per 10 tons |
| 4 | 0.80 | 0.18 | 0.52 | 0.002 | 0.00 | 0.00 | 0.00 | 0.00 | 0.00 | 15 | 24 | 0.0011 | 9.8 | 0.0 | 3.1 |
| 5 | 0.81 | 0.19 | 0.55 | 0.003 | 0.25 | 0.31 | 0.43 | 15.45 | 0.00 | 0 | 0 | 0.0022 | 6.7 | 0.0 | 2.5 |
| 6 | 0.83 | 0.22 | 0.61 | 0.001 | 0.00 | 0.62 | 0.00 | 0.00 | 0.00 | 68 | 0 | 0.0035 | 8.5 | 0.0 | 2.0 |
| 7 | 1.05 | 0.25 | 0.58 | 0.001 | 0.55 | 0.00 | 0.65 | 0.03 | 0.00 | 0 | 0 | 0.0031 | 12.5 | 0.0 | 2.2 |
| 8 | 0.97 | 0.23 | 0.56 | 0.002 | 0.92 | 0.84 | 1.37 | 1.87 | 0.06 | 13 | 37 | 0.0036 | 14.3 | 0.0 | 3.5 |
| 9 | 0.88 | 0.34 | 0.47 | 0.003 | 0.00 | 0.00 | 0.00 | 0.02 | 8.40 | 0 | 0 | 0.0038 | 18.7 | 0.0 | 7.6 |
| 10 | 0.82 | 0.24 | 0.49 | 0.002 | 0.00 | 0.00 | 0.00 | 0.00 | 0.00 | 0 | 0 | 0.0033 | 15.2 | 0.0 | 9.1 |
| 11 | 0.77 | 0.24 | 0.63 | 0.001 | 0.00 | 0.50 | 0.00 | 0.00 | 0.00 | 32 | 55 | 0.0004 | 0.5 | 1.5 | 12.7 |
| 12 | 0.72 | 0.31 | 0.42 | 0.001 | 0.00 | 0.00 | 0.00 | 0.00 | 0.00 | 0 | 0 | 0.0003 | 0.6 | 1.8 | 13.9 |
| 13 | 0.77 | 0.20 | 0.63 | 0.002 | 0.00 | 0.65 | 1.41 | 0.00 | 0.00 | 26 | 0 | 0.0049 | 25.6 | 0.0 | 15.5 |
| 14 | 0.82 | 0.15 | 0.63 | 0.001 | 0.00 | 0.00 | 0.00 | 0.00 | 0.00 | 0 | 0 | 0.0066 | 27.3 | 0.0 | 16.8 |
| 15 | 0.97 | 0.30 | 0.60 | 0.001 | 0.51 | 0.00 | 0.67 | 0.00 | 0.00 | 0 | 0 | 0.0089 | 31.1 | 0.0 | 19.8 |

※The remainder includes iron and innevitable impurities

TABLE 2

Object: No. 3
Observation area: 171 mm²
Number of inclusions at least 2 mm in diameter: 6

| Inclusions | Width | EPMA measurement value (mass percent) | | | | | | | | | |
|---|---|---|---|---|---|---|---|---|---|---|---|
| No. | μm | MgO | $Al_2O_3$ | $SiO_2$ | CaO | MnO | $TiO_2$ | $ZrO_2$ | $K_2O$ | S | $Na_2O$ |
| 3-1 | 2 | 3.93 | 0.66 | 49.78 | 22.27 | 19.87 | 0.00 | 0.00 | 0.00 | 3.49 | 0.00 |
| 3-2 | 4 | 1.81 | 2.71 | 50.00 | 32.01 | 12.67 | 0.45 | 0.00 | 0.11 | 0.00 | 0.23 |
| 3-3 | 3 | 0.60 | 0.00 | 46.71 | 34.13 | 16.77 | 0.00 | 0.00 | 0.00 | 0.00 | 1.80 |
| 3-4 | 2 | 4.05 | 0.75 | 53.97 | 29.09 | 10.79 | 0.00 | 0.90 | 0.15 | 0.15 | 0.15 |
| 3-5 | 4 | 1.41 | 3.95 | 52.12 | 31.36 | 10.73 | 0.00 | 0.00 | 0.14 | 0.00 | 0.28 |
| 3-6 | 5 | 1.22 | 1.43 | 41.12 | 49.29 | 6.84 | 0.00 | 0.00 | 0.10 | 0.00 | 0.00 |

| Inclusions | Converted as MgO + MnO + $Al_2O_3$ + $SiO_2$ + CaO = 100% (mass %) | | | | | | Converted as $Al_2O_3$ + $SiO_2$ + CaO = 100% (mass %) | | | Composition |
|---|---|---|---|---|---|---|---|---|---|---|
| No. | MgO | MnO | Al2O3 | SiO2 | CaO | Al2O3 + SiO2 + CaO | Al2O3 | SiO2 | CaO | |
| 3-1 | 4.07 | 20.59 | 0.68 | 51.58 | 23.08 | 75.34 | 0.90 | 68.47 | 30.63 | A |
| 3-2 | 1.82 | 12.77 | 2.74 | 50.40 | 32.27 | 85.40 | 3.20 | 59.01 | 37.78 | A |
| 3-3 | 0.61 | 17.07 | 0.00 | 47.56 | 34.76 | 82.32 | 0.00 | 57.78 | 42.22 | A |
| 3-4 | 4.10 | 10.94 | 0.76 | 54.71 | 29.48 | 84.95 | 0.89 | 64.40 | 34.70 | A |
| 3-5 | 1.42 | 10.78 | 3.97 | 52.34 | 31.49 | 87.80 | 4.52 | 59.61 | 35.86 | A |
| 3-6 | 1.23 | 6.84 | 1.43 | 41.16 | 49.34 | 91.93 | 1.56 | 44.77 | 53.67 | B |

TABLE 3

Object: No. 7
Observation area: 152 mm²
Number of inclusions at least 2 mm in diameter: 19

| Inclusions | Width | EPMA measurement value (mass percent) | | | | | | | | | |
|---|---|---|---|---|---|---|---|---|---|---|---|
| No. | μm | MgO | $Al_2O_3$ | $SiO_2$ | CaO | MnO | $TiO_2$ | $ZrO_2$ | $K_2O$ | S | $Na_2O$ |
| 7-1 | 3 | 1.54 | 19.38 | 48.03 | 20.37 | 9.13 | 0.00 | 0.14 | 0.42 | 0.14 | 0.84 |
| 7-2 | 3 | 2.38 | 10.79 | 49.94 | 22.08 | 12.92 | 0.00 | 0.25 | 0.38 | 1.13 | 0.13 |
| 7-3 | 5 | 2.00 | 17.51 | 49.62 | 24.58 | 5.68 | 0.00 | 0.46 | 0.15 | 0.00 | 0.00 |
| 7-4 | 5 | 1.59 | 14.74 | 49.63 | 27.78 | 5.41 | 0.21 | 0.00 | 0.21 | 0.00 | 0.42 |
| 7-5 | 2 | 4.41 | 3.02 | 57.54 | 21.58 | 11.83 | 0.23 | 0.70 | 0.70 | 0.00 | 0.00 |
| 7-6 | 3 | 2.46 | 1.16 | 54.48 | 25.29 | 16.33 | 0.00 | 0.00 | 0.00 | 0.14 | 0.14 |
| 7-7 | 2 | 1.42 | 2.43 | 53.04 | 27.73 | 14.57 | 0.00 | 0.61 | 0.00 | 0.20 | 0.00 |
| 7-8 | 5 | 0.78 | 20.88 | 46.47 | 27.94 | 3.43 | 0.00 | 0.00 | 0.29 | 0.10 | 0.10 |
| 7-9 | 5 | 1.87 | 8.42 | 48.65 | 31.81 | 7.69 | 0.52 | 0.00 | 0.52 | 0.10 | 0.42 |
| 7-10 | 2 | 2.30 | 2.81 | 56.12 | 29.08 | 6.89 | 0.00 | 0.00 | 0.77 | 0.00 | 2.04 |
| 7-11 | 2 | 2.81 | 1.82 | 50.25 | 29.26 | 14.05 | 0.00 | 0.00 | 0.33 | 0.00 | 1.49 |
| 7-12 | 3 | 2.75 | 0.96 | 51.37 | 28.20 | 15.65 | 0.24 | 0.36 | 0.24 | 0.24 | 0.00 |
| 7-13 | 5 | 2.35 | 2.56 | 50.96 | 30.60 | 12.58 | 0.53 | 0.00 | 0.21 | 0.11 | 0.11 |

TABLE 3-continued

| Object: No. 7<br>Observation area: 152 mm$^2$<br>Number of inclusions at least 2 mm in diameter: 19 | | | | | | | | | | | |
|---|---|---|---|---|---|---|---|---|---|---|---|
| 7-14 | 2 | 2.23 | 9.64 | 48.32 | 26.96 | 12.29 | 0.42 | 0.00 | 0.00 | 0.14 | 0.00 |
| 7-15 | 4 | 3.92 | 0.00 | 56.70 | 24.67 | 14.05 | 0.49 | 0.16 | 0.00 | 0.00 | 0.00 |
| 7-16 | 5 | 4.50 | 6.50 | 56.75 | 21.25 | 10.25 | 0.00 | 0.00 | 0.00 | 0.25 | 0.50 |
| 7-17 | 3 | 2.53 | 2.22 | 55.70 | 21.52 | 15.51 | 0.00 | 0.00 | 0.00 | 0.00 | 2.53 |
| 7-18 | 3 | 0.77 | 1.16 | 54.55 | 34.43 | 8.51 | 0.00 | 0.58 | 0.00 | 0.00 | 0.00 |
| 7-19 | 3 | 2.88 | 2.21 | 54.42 | 31.86 | 5.09 | 0.00 | 1.11 | 0.00 | 0.44 | 1.99 |

| Inclusions | Converted as MgO + MnO + $Al_2O_3$ + $SiO_2$ + CaO = 100% (mass %) | | | | | | Converted as $Al_2O_3$ + $SiO_2$ + CaO = 100% (mass %) | | | Com- |
|---|---|---|---|---|---|---|---|---|---|---|
| No. | MgO | MnO | $Al_2O_3$ | $SiO_2$ | CaO | $Al_2O_3$ + $SiO_2$ + CaO | $Al_2O_3$ | $SiO_2$ | CaO | posi-tion |
| 7-1 | 1.57 | 9.27 | 19.69 | 48.79 | 20.68 | 89.16 | 22.08 | 54.72 | 23.20 | A |
| 7-2 | 2.43 | 13.17 | 11.00 | 50.90 | 22.51 | 84.40 | 13.03 | 60.30 | 26.67 | A |
| 7-3 | 2.01 | 5.72 | 17.62 | 49.92 | 24.73 | 92.27 | 19.10 | 54.10 | 26.80 | A |
| 7-4 | 1.60 | 5.45 | 14.87 | 50.05 | 28.02 | 92.94 | 16.00 | 53.86 | 30.15 | A |
| 7-5 | 4.48 | 12.03 | 3.07 | 58.49 | 21.93 | 83.49 | 3.67 | 70.06 | 26.27 | A |
| 7-6 | 2.46 | 16.38 | 1.16 | 54.64 | 25.36 | 81.16 | 1.43 | 67.32 | 31.25 | A |
| 7-7 | 1.43 | 14.69 | 2.45 | 53.47 | 27.96 | 83.88 | 2.92 | 63.75 | 33.33 | A |
| 7-8 | 0.79 | 3.45 | 20.99 | 46.70 | 28.08 | 95.76 | 21.91 | 48.77 | 29.32 | A |
| 7-9 | 1.90 | 7.81 | 8.55 | 49.42 | 32.31 | 90.29 | 9.47 | 54.74 | 35.79 | A |
| 7-10 | 2.36 | 7.09 | 2.89 | 57.74 | 29.92 | 90.55 | 3.19 | 63.77 | 33.04 | A |
| 7-11 | 2.86 | 14.31 | 1.85 | 51.18 | 29.80 | 82.83 | 2.24 | 61.79 | 35.98 | A |
| 7-12 | 2.78 | 15.82 | 0.97 | 51.93 | 28.50 | 81.40 | 1.19 | 63.80 | 35.01 | A |
| 7-13 | 2.37 | 12.70 | 2.58 | 51.45 | 30.89 | 84.93 | 3.04 | 60.58 | 36.38 | A |
| 7-14 | 2.25 | 12.36 | 9.69 | 48.60 | 27.11 | 85.39 | 11.35 | 56.91 | 31.74 | A |
| 7-15 | 3.95 | 14.14 | 0.00 | 57.07 | 24.84 | 81.91 | 0.00 | 69.68 | 30.32 | A |
| 7-16 | 4.53 | 10.33 | 6.55 | 57.18 | 21.41 | 85.14 | 7.69 | 67.16 | 25.15 | A |
| 7-17 | 2.60 | 15.91 | 2.27 | 57.14 | 22.08 | 81.49 | 2.79 | 70.12 | 27.09 | A |
| 7-18 | 0.78 | 8.56 | 1.17 | 54.86 | 34.63 | 90.66 | 1.29 | 60.52 | 38.20 | A |
| 7-19 | 2.98 | 5.28 | 2.29 | 56.42 | 33.03 | 91.74 | 2.50 | 61.50 | 36.00 | A |

From Table 1, the following consideration can be made (the following Nos. indicate numbers of experiments in Table 1).

It is known that since Nos. 1 to 10 satisfy a specification of the embodiment of the invention, they have small number of breakages during the drawing process, or excellent drawability. On the contrary, Nos. 11 to 15 do not satisfy the specification of the embodiment of the invention, resulting in large number of breakages during the drawing process, showing inferior drawability. In particular, in Nos. 11 to 12, since the composition-A-inclusions are insufficient, but the composition-B inclusions exist, excellent drawability can not be secured. In Nos. 13 to 15, since the composition-A-inclusions are excessively contained, drawability is bad.

Example 2

Evaluation of Fatigue Properties

As in the example 1, pretreatment of molten iron, converter operation, slag refining, continuous casting, blooming, and hot rolling were performed to obtain wire rods 8 mm in diameter, then a composition, size and the number of inclusions in the obtained wire rods were measured in the same method as in the example 1. As examples of detailed measurement results of morphologies of the inclusions, a measurement result of No. 18 is shown in Table 5, and a measurement result of No. 22 is shown in Table 6. Similar measurement was performed for other examples.

Next, fatigue properties in the case that the wire rods are used for springs are evaluated according to the following procedure.

[Evaluation Method]

Fatigue properties of steel wire rods 8.0 mm in diameter were evaluated by the Nakamura-type rotating-bending fatigue test.

[Preparation Method and Test Method of Specimens]

Wire rods 8.0 mm in diameter were subjected to oil tempering, straightening annealing, and shot peening treatment, then subjected to straightening annealing again, and then subjected to a fatigue test at the following condition using a Nakamura-type rotating-bending fatigue test machine, thereby fracture ratios were obtained for evaluating fatigue properties.

The results are shown together in Table 4 showing the chemical compositions of the steel wire rods.

[Fatigue Test Condition]

Length of test piece: 650 mm

Number of test pieces: 30

Test load: 95.8 kgf/mm$^2$ (940 MPa)

Rotation speed: 4500 rpm

Number of suspension times of test: $2\times10^7$ times

Calculation formula of fracture ratio: fracture ratio=fracture number/(number of all test pieces)×100(%)

TABLE 4

| No. | Chemical composition※ (Li, Na, Ce, and La are in ppm, others are in mass percent) C | Si | Mn | Al | Ni | Cu | Cr | Li | Na | Ce | La | Gas flow rate ($Nm^3$/min * t) | Number of inclusions/100 $mm^2$ Composition A | Composition B | Snapping ratio in fatigue test (%) |
|---|---|---|---|---|---|---|---|---|---|---|---|---|---|---|---|
| 16 | 0.58 | 1.45 | 0.55 | 0.002 | 0.00 | 0.00 | 0.00 | 0.00 | 0.00 | 0 | 0 | 0.0006 | 7.7 | 0.0 | 33 |
| 17 | 0.62 | 1.85 | 0.85 | 0.002 | 0.00 | 0.00 | 0.00 | 0.00 | 0.00 | 0 | 0 | 0.0008 | 3.1 | 0.0 | 42 |
| 18 | 0.67 | 1.93 | 0.77 | 0.001 | 0.00 | 0.00 | 0.00 | 0.19 | 0.00 | 0 | 0 | 0.0010 | 3.8 | 0.4 | 23 |
| 19 | 0.70 | 2.02 | 0.82 | 0.001 | 0.33 | 0.00 | 1.21 | 0.00 | 0.02 | 0 | 0 | 0.0012 | 6.7 | 0.0 | 40 |
| 20 | 0.65 | 1.51 | 0.61 | 0.001 | 0.00 | 0.21 | 0.00 | 0.00 | 0.00 | 0 | 5 | 0.0023 | 9.8 | 0.0 | 27 |
| 21 | 0.72 | 1.99 | 0.75 | 0.003 | 0.92 | 0.84 | 1.37 | 0.32 | 0.10 | 52 | 81 | 0.0021 | 13.1 | 0.0 | 35 |
| 22 | 0.68 | 1.87 | 0.77 | 0.002 | 0.00 | 0.00 | 0.00 | 0.00 | 0.00 | 73 | 78 | 0.0028 | 12.0 | 0.0 | 37 |
| 23 | 0.59 | 1.51 | 0.61 | 0.001 | 0.54 | 0.68 | 0.00 | 0.00 | 0.00 | 0 | 0 | 0.0039 | 13.1 | 0.0 | 27 |
| 24 | 0.70 | 1.99 | 0.75 | 0.003 | 0.00 | 0.00 | 1.15 | 0.00 | 0.00 | 5 | 0 | 0.0018 | 19.5 | 0.0 | 41 |
| 25 | 0.71 | 1.80 | 0.77 | 0.002 | 0.00 | 0.00 | 0.00 | 0.00 | 0.00 | 0 | 94 | 0.0040 | 18.5 | 0.7 | 43 |
| 26 | 0.61 | 1.47 | 0.68 | 0.002 | 0.00 | 0.00 | 0.00 | 0.00 | 0.00 | 0 | 0 | 0.0003 | 0.5 | 1.4 | 71 |
| 27 | 0.68 | 1.99 | 0.76 | 0.001 | 0.00 | 0.00 | 0.86 | 0.52 | 0.06 | 0 | 0 | 0.0004 | 0.6 | 1.9 | 62 |
| 28 | 0.68 | 1.91 | 0.88 | 0.001 | 0.34 | 0.00 | 1.25 | 0.00 | 0.00 | 0 | 0 | 0.0051 | 26.3 | 0.0 | 77 |
| 29 | 0.59 | 1.46 | 0.81 | 0.003 | 0.00 | 0.00 | 0.00 | 0.00 | 0.00 | 0 | 0 | 0.0073 | 32.2 | 0.0 | 73 |
| 30 | 0.62 | 1.74 | 0.74 | 0.002 | 0.00 | 0.48 | 1.29 | 0.30 | 0.00 | 44 | 0 | 0.0090 | 37.2 | 0.0 | 86 |

※the remainder includes iron and innevitable impurities

TABLE 5

Object: No. 18
Observation area: 260 $mm^2$
Number of inclusions at least 2 mm in diameter: 11

| Inclusions No. | Width μm | EPMA measurement value (mass percent) MgO | $Al_2O_3$ | $SiO_2$ | CaO | MnO | $TiO_2$ | $ZrO_2$ | $K_2O$ | S | $Na_2O$ |
|---|---|---|---|---|---|---|---|---|---|---|---|
| 18-1 | 3 | 1.17 | 1.91 | 44.64 | 28.49 | 19.68 | 0.29 | 0.00 | 0.29 | 3.52 | 0.00 |
| 18-2 | 5 | 1.55 | 17.46 | 49.72 | 23.43 | 6.74 | 0.00 | 0.00 | 0.77 | 0.00 | 0.33 |
| 18-3 | 3 | 8.90 | 12.18 | 47.07 | 20.37 | 7.96 | 1.17 | 0.00 | 0.70 | 0.00 | 1.64 |
| 18-4 | 3 | 2.65 | 1.39 | 53.14 | 29.29 | 12.97 | 0.14 | 0.00 | 0.28 | 0.00 | 0.14 |
| 18-5 | 3 | 3.30 | 1.98 | 55.12 | 29.37 | 6.93 | 0.00 | 0.66 | 0.00 | 0.33 | 2.31 |
| 18-6 | 3 | 6.60 | 2.06 | 58.14 | 18.76 | 14.43 | 0.00 | 0.00 | 0.00 | 0.00 | 0.00 |
| 18-7 | 4 | 2.75 | 7.64 | 50.10 | 30.45 | 8.86 | 0.10 | 0.00 | 0.10 | 0.00 | 0.00 |
| 18-8 | 4 | 0.63 | 26.47 | 41.60 | 28.57 | 1.47 | 0.21 | 0.00 | 0.84 | 0.21 | 0.00 |
| 18-9 | 5 | 8.47 | 22.84 | 46.39 | 19.06 | 1.78 | 0.10 | 0.00 | 0.73 | 0.10 | 0.52 |
| 18-10 | 3 | 5.13 | 2.74 | 54.53 | 26.32 | 10.26 | 0.00 | 0.68 | 0.34 | 0.00 | 0.00 |
| 18-11 | 2 | 8.67 | 1.16 | 14.45 | 46.24 | 1.16 | 14.45 | 0.00 | 0.58 | 1.16 | 12.14 |

| Inclusions No. | Converted as MgO + MnO + $Al_2O_3$ + $SiO_2$ + CaO = 100% (mass %) MgO | MnO | $Al_2O_3$ | $SiO_2$ | CaO | $Al_2O_3$ + $SiO_2$ + CaO | Converted as $Al_2O_3$ + $SiO_2$ + CaO = 100% (mass %) $Al_2O_3$ | $SiO_2$ | CaO |
|---|---|---|---|---|---|---|---|---|---|
| 18-1 | 1.23 | 20.52 | 1.99 | 46.55 | 29.71 | 78.25 | 2.54 | 59.49 | 37.97 |
| 18-2 | 1.56 | 6.82 | 17.65 | 50.28 | 23.69 | 91.62 | 19.26 | 54.88 | 25.86 |
| 18-3 | 9.22 | 8.25 | 12.62 | 48.79 | 21.12 | 82.53 | 15.29 | 59.12 | 25.59 |
| 18-4 | 2.66 | 13.04 | 1.40 | 53.44 | 29.45 | 84.29 | 1.66 | 63.40 | 34.94 |
| 18-5 | 3.41 | 7.17 | 2.05 | 57.00 | 30.38 | 89.43 | 2.29 | 63.74 | 33.97 |
| 18-6 | 6.60 | 14.43 | 2.06 | 58.14 | 18.76 | 78.96 | 2.61 | 73.63 | 23.76 |
| 18-7 | 2.76 | 8.88 | 7.65 | 50.20 | 30.51 | 88.36 | 8.66 | 56.81 | 34.53 |
| 18-8 | 0.64 | 1.49 | 26.81 | 42.13 | 28.94 | 97.88 | 27.39 | 43.04 | 29.57 |
| 18-9 | 8.59 | 1.81 | 23.18 | 47.08 | 19.34 | 89.60 | 25.87 | 52.54 | 21.58 |
| 18-10 | 5.18 | 10.36 | 2.76 | 55.09 | 26.60 | 84.45 | 3.27 | 65.23 | 31.50 |
| 18-11 | 12.10 | 1.61 | 1.61 | 20.16 | 64.52 | 86.29 | 1.87 | 23.36 | 74.77 |

TABLE 6

Object: No. 22
Observation area: 158 $mm^2$
Number of inclusions at least 2 mm in diameter: 19

| Inclusions No. | Width μm | EPMA measurement value (mass percent) MgO | $Al_2O_3$ | $SiO_2$ | CaO | MnO | $TiO_2$ | $ZrO_2$ | $K_2O$ | S | $Na_2O$ |
|---|---|---|---|---|---|---|---|---|---|---|---|
| 22-1 | 5 | 3.93 | 5.77 | 53.12 | 25.98 | 10.62 | 0.23 | 0.00 | 0.23 | 0.00 | 0.12 |
| 22-2 | 5 | 3.17 | 13.99 | 49.18 | 20.11 | 11.37 | 0.66 | 0.22 | 0.33 | 0.33 | 0.66 |

TABLE 6-continued

| Object: No. 22<br>Observation area: 158 mm$^2$<br>Number of inclusions at least 2 mm in diameter: 19 | | | | | | | | | | | |
|---|---|---|---|---|---|---|---|---|---|---|---|
| 22-3 | 3 | 3.68 | 11.68 | 55.04 | 18.08 | 10.24 | 0.00 | 0.16 | 0.32 | 0.16 | 0.64 |
| 22-4 | 3 | 3.50 | 1.67 | 50.15 | 29.64 | 14.59 | 0.00 | 0.46 | 0.00 | 0.00 | 0.00 |
| 22-5 | 3 | 3.87 | 1.13 | 47.74 | 29.35 | 15.81 | 0.32 | 0.00 | 0.16 | 1.61 | 0.00 |
| 22-6 | 3 | 5.62 | 0.37 | 52.43 | 23.60 | 14.23 | 0.00 | 1.12 | 0.00 | 0.00 | 2.62 |
| 22-7 | 3 | 3.85 | 1.42 | 51.42 | 29.96 | 13.36 | 0.00 | 0.00 | 0.00 | 0.00 | 0.00 |
| 22-8 | 4 | 2.13 | 1.13 | 53.20 | 38.64 | 4.39 | 0.13 | 0.00 | 0.13 | 0.00 | 0.25 |
| 22-9 | 5 | 2.60 | 1.73 | 52.97 | 31.06 | 10.77 | 0.37 | 0.00 | 0.12 | 0.00 | 0.37 |
| 22-10 | 3 | 1.07 | 0.53 | 52.58 | 35.83 | 9.98 | 0.00 | 0.00 | 0.00 | 0.00 | 0.00 |
| 22-11 | 3 | 1.68 | 0.48 | 55.16 | 36.93 | 5.52 | 0.00 | 0.24 | 0.00 | 0.00 | 0.00 |
| 22-12 | 3 | 2.18 | 11.53 | 53.27 | 19.00 | 13.08 | 0.00 | 0.62 | 0.00 | 0.00 | 0.31 |
| 22-13 | 3 | 1.22 | 3.50 | 45.44 | 39.36 | 9.73 | 0.00 | 0.00 | 0.30 | 0.00 | 0.46 |
| 22-14 | 5 | 3.55 | 1.01 | 54.73 | 28.04 | 11.99 | 0.00 | 0.00 | 0.00 | 0.00 | 0.68 |
| 22-15 | 3 | 19.73 | 7.62 | 47.53 | 17.04 | 4.26 | 1.79 | 0.90 | 0.00 | 0.00 | 1.12 |
| 22-16 | 3 | 1.55 | 0.71 | 53.17 | 35.12 | 8.18 | 0.00 | 0.28 | 0.00 | 0.28 | 0.71 |
| 22-17 | 3 | 0.68 | 27.48 | 44.37 | 22.97 | 2.25 | 0.00 | 0.23 | 0.68 | 0.00 | 1.35 |
| 22-18 | 3 | 3.45 | 12.93 | 51.29 | 23.71 | 8.62 | 0.00 | 0.00 | 0.00 | 0.00 | 0.00 |
| 22-19 | 2 | 6.07 | 0.42 | 55.02 | 21.76 | 15.06 | 0.42 | 0.63 | 0.00 | 0.21 | 0.42 |

| Inclusions | Converted as MgO + MnO + $Al_2O_3$ + $SiO_2$ + CaO = 100% (mass %) | | | | | | Converted as $Al_2O_3$ + $SiO_2$ + CaO = 100% (mass %) | | | Com- |
|---|---|---|---|---|---|---|---|---|---|---|
| No. | MgO | MnO | $Al_2O_3$ | $SiO_2$ | CaO | $Al_2O_3$ + $SiO_2$ + CaO | $Al_2O_3$ | $SiO_2$ | CaO | posi-tion |
| 22-1 | 3.95 | 10.69 | 5.81 | 53.43 | 26.13 | 85.37 | 6.81 | 62.59 | 30.61 | A |
| 22-2 | 3.24 | 11.62 | 14.30 | 50.28 | 20.56 | 85.14 | 16.80 | 59.06 | 24.15 | A |
| 22-3 | 3.73 | 10.37 | 11.83 | 55.75 | 18.31 | 85.89 | 13.77 | 64.91 | 21.32 | A |
| 22-4 | 3.51 | 14.66 | 1.68 | 50.38 | 29.77 | 81.83 | 2.05 | 61.57 | 36.38 | A |
| 22-5 | 3.95 | 16.14 | 1.15 | 48.76 | 29.98 | 79.89 | 1.44 | 61.03 | 37.53 | A |
| 22-6 | 5.84 | 14.79 | 0.39 | 54.47 | 24.51 | 79.37 | 0.49 | 68.63 | 30.88 | A |
| 22-7 | 3.85 | 13.36 | 1.42 | 51.42 | 29.96 | 82.80 | 1.71 | 62.10 | 36.18 | A |
| 22-8 | 2.14 | 4.41 | 1.13 | 53.47 | 38.84 | 93.44 | 1.21 | 57.22 | 41.57 | A |
| 22-9 | 2.62 | 10.86 | 1.75 | 53.43 | 31.34 | 86.52 | 2.02 | 61.75 | 36.22 | A |
| 22-10 | 1.07 | 9.98 | 0.53 | 52.58 | 35.83 | 88.94 | 0.60 | 59.12 | 40.29 | A |
| 22-11 | 1.68 | 5.53 | 0.48 | 55.29 | 37.02 | 92.79 | 0.52 | 59.59 | 39.90 | A |
| 22-12 | 2.20 | 13.21 | 11.64 | 53.77 | 19.18 | 84.59 | 13.76 | 63.57 | 22.67 | A |
| 22-13 | 1.23 | 9.80 | 3.52 | 45.79 | 39.66 | 88.97 | 3.96 | 51.47 | 44.58 | A |
| 22-14 | 3.57 | 12.07 | 1.02 | 55.10 | 28.23 | 84.35 | 1.21 | 65.32 | 33.47 | A |
| 22-15 | 20.51 | 4.43 | 7.93 | 49.42 | 17.72 | 75.07 | 10.56 | 65.83 | 23.60 | A |
| 22-16 | 1.57 | 8.29 | 0.71 | 53.86 | 35.57 | 90.14 | 0.79 | 59.75 | 39.46 | A |
| 22-17 | 0.69 | 2.30 | 28.11 | 45.39 | 23.50 | 97.00 | 28.98 | 46.79 | 24.23 | A |
| 22-18 | 3.45 | 8.62 | 12.93 | 51.29 | 23.71 | 87.93 | 14.70 | 58.33 | 26.96 | A |
| 22-19 | 6.17 | 15.32 | 0.43 | 55.96 | 22.13 | 78.52 | 0.55 | 71.27 | 28.18 | A |

From Table 4, the following consideration can be made (the following Nos. indicate numbers of experiments in Table 4).

It is known that since Nos. 16 to 25 satisfy the specification of the embodiment of the invention, they have small number of breakages during the drawing process, or excellent drawability. On the contrary, Nos. 26 to 30 do not satisfy the specification of the embodiment of the invention, resulting in large number of fractures during the drawing process, showing inferior fatigue properties. In particular, in Nos. 26 to 27, since the composition-A-inclusions are insufficient, but the composition-B inclusions exist, excellent fatigue properties can not be secured. In Nos. 28 to 30, since the composition-A-inclusions are excessively contained, fatigue properties are bad.

What is claimed is:

1. A steel wire rod comprising:

0.4 to 1.3% of C (mass percent, hereinafter same for steel composition), 0.1 to 2.5% of Si, 0.2 to 1.0% of Mn, and 0.003% or less of Al (exceeding 0%);

wherein oxide base inclusions in any section comprising an axis line of the steel wire rod have a width of 2 μm or more perpendicular to a direction of the axis line, and satisfy following composition X, wherein composition X has, when a composition of inclusions is converted to $Al_2O_3$+MgO+CaO+$SiO_2$+MnO=100% (mass percent, hereinafter same for inclusions), $Al_2O_3$+CaO+$SiO_2$≥70%; and a number of the oxide base inclusions satisfying following composition A is in a range of from 2.9 to 20 per 100 mm$^2$ section, and the number of the oxide base inclusions satisfying following composition B is less than 1 per 100 mm$^2$ section, wherein composition A has, when the composition of inclusions is converted to $Al_2O_3$+CaO+$SiO_2$=100%, 20% CaO≤50% and $Al_2O_3$≤30%; and composition B has, when the composition of inclusions is converted to $Al_2O_3$+CaO+$SiO_2$=100%, CaO>50%, wherein a drawability of the steel wire rod is in a range of from 2.0 to 6.0 where the drawability is defined by a number of disconnections per 10 tons when the wire rod is subjected to drawing from 5.5 mm in diameter to 0.2 mm in diameter.

2. The steel wire rod according to claim 1, further comprising:

0.05 to 1% of Ni.

3. The steel wire rod according to claim 1, further comprising:

at least one of 0.05 to 1% of Cu and 0.05 to 1.5% of Cr.

4. The steel wire rod according to claim 1, further comprising:

at least one selected from a group including 0.02 to 20 ppm of Li, 0.02 to 20 ppm of Na, 3 to 100 ppm of Ce, and 3 to 100 ppm of La.

5. The steel wire according to claim 1, wherein the number of the oxide base inclusions satisfying said composition B is less than 0.7 per section of 100 $mm^2$.

6. The steel wire rod according to claim 1, wherein the composition A has $25.15\% < CaO \leq 50\%$ and $Al_2O_3 \leq 30\%$ when the composition A of inclusions is converted to $Al_2O_3 + CaO + SiO_2 = 100\%$.

7. The steel wire rod according to claim 1, wherein the steel wire rod comprises:

0.4 to 1.2% of C (mass percent, hereinafter same for steel composition), 0.1 to 2.3% of Si, 0.2 to 0.9% of Mn, and 0.002% or less of Al (exceeding 0%).

8. The steel wire rod according to claim 1, wherein the steel wire rod further comprises 0.4 to 1.2% of C (mass percent, hereinafter same for steel composition), 0.1 to 2.3% of Si, 0.05 to 1% of Ni, 0.05 to 1% of Cu, 0.05 to 1.5% Cr, 0.2 to 0.9% of Mn, and 0.002% or less of Al (exceeding 0%).

9. The steel wire rod according to claim 1, further comprising:

at least one selected from the group consisting of 0.03 to 20 ppm of Li, 0.03 to 20 ppm of Na, 5 to 100 ppm of Ce, and 5 to 100 ppm of La.

* * * * *